US012628989B2

(12) United States Patent
Maheu et al.

(10) Patent No.: US 12,628,989 B2
(45) Date of Patent: May 19, 2026

(54) TILEABLE MODULAR FLOOR SYSTEM AND DRAIN

(71) Applicant: LATICRETE INTERNATIONAL, INC., Bethany, CT (US)

(72) Inventors: Spencer P Maheu, Bethany, CT (US); Dustin Prevete, Bethany, CT (US)

(73) Assignee: LATICRETE INTERNATIONAL, INC., Bethany, CT (US)

( * ) Notice: Subject to any disclaimer, the term of this patent is extended or adjusted under 35 U.S.C. 154(b) by 374 days.

(21) Appl. No.: 18/091,964

(22) Filed: Dec. 30, 2022

(65) Prior Publication Data

US 2023/0210315 A1 Jul. 6, 2023

Related U.S. Application Data

(60) Provisional application No. 63/295,801, filed on Dec. 31, 2021.

(51) Int. Cl.

| | |
|---|---|
| ***A47K 3/40*** | (2006.01) |
| ***E03F 5/04*** | (2006.01) |
| ***E04F 15/02*** | (2006.01) |

(52) U.S. Cl.

CPC ..... *A47K 3/405* (2013.01); *E03F 5/0408* (2013.01); *E04F 15/02188* (2013.01)

(58) Field of Classification Search

CPC ..... A47K 3/405; E03F 5/0408; E03F 5/0409; E04F 15/02188

USPC ..... 52/302.1

See application file for complete search history.

(56) References Cited

U.S. PATENT DOCUMENTS

| | | | | |
|---|---|---|---|---|
| 5,140,789 | A * | 8/1992 | De Gooyer | A47K 3/40 4/613 |
| 5,615,526 | A * | 4/1997 | Palmer | E04D 13/0431 52/302.1 |
| 6,058,659 | A * | 5/2000 | Astrom | E04F 15/02 52/302.1 |
| 6,647,565 | B2 * | 11/2003 | Smale | A47K 3/40 4/584 |
| 7,979,927 | B2 | 7/2011 | Daniels | |
| 8,365,487 | B2 * | 2/2013 | Krusec | E04D 13/1693 52/90.2 |
| 2002/0124306 | A1 * | 9/2002 | Smale | E04F 15/02 4/613 |
| 2004/0244320 | A1 * | 12/2004 | Kalisiak | E01C 5/20 52/503 |
| 2006/0213006 | A1 * | 9/2006 | Rush | A47K 3/40 4/613 |
| 2014/0317841 | A1 * | 10/2014 | DeJesus | A47K 3/40 52/741.41 |

(Continued)

*Primary Examiner* — Brent W Herring

(74) *Attorney, Agent, or Firm* — DeLio Peterson & Curcio LLC; Kelly M. Nowak

(57) ABSTRACT

Modular floor drain systems that include symmetric substrate segments each having outwardly extending flanges for overlapping an adjacent edge of the other substrate segment. The system also includes a drain segment connected to the two or more symmetric substrate segments via at least one of the outwardly extending flanges. The symmetric substrate segments have identical configurations enabling interchangeable use thereof and complementary mating for ease of installation of the modular floor drain system. The substrate segments may have hinges for bending the symmetric substrate segment to allow for folding thereof.

20 Claims, 20 Drawing Sheets

(56) References Cited

U.S. PATENT DOCUMENTS

2016/0298324 A1* 10/2016 Blamble ..... E03F 3/046
2020/0157794 A1* 5/2020 Self ..... E03C 1/01

* cited by examiner

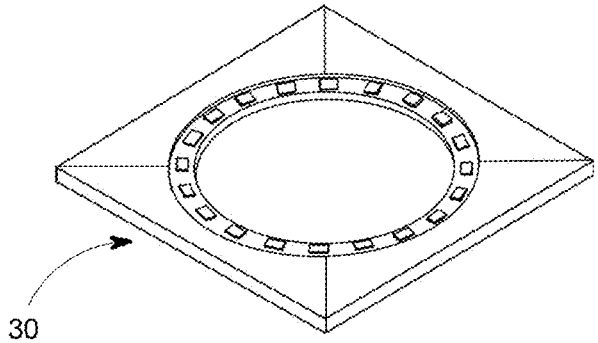
FIG. 40
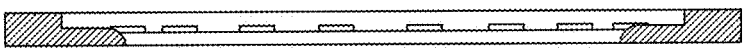
FIG. 41
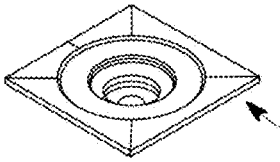
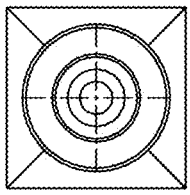
FIG. 42A
FIG. 42B
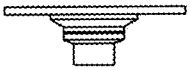
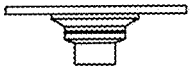
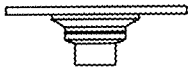
FIG. 42C
FIG. 42D
FIG. 42E
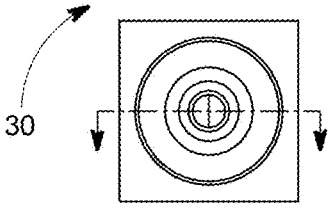
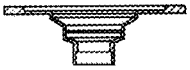
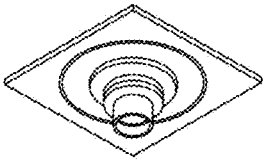
FIG. 42F
FIG. 42G
FIG. 42H

TILEABLE MODULAR FLOOR SYSTEM AND DRAIN

BACKGROUND OF THE INVENTION

This invention relates to a modular floor drain substrate system for installation over drainable floors (e.g., shower floors), which may receive facing materials such as ceramic tiles.

2. DESCRIPTION OF RELATED ART

During installation of drainable floors, such as showers, it is important that the final laid floor be sloped to guide water toward the drain for facilitating shower drainage and reduce the potential for leaks. Common installation techniques include use of hand-laid cement mortar shower bases (i.e., mud beds), or alternatively prefabricated shower pans, both of which are sloped for proper drainage. Once installed, facing materials, such as ceramic tiles, are typically provided over these mud beds or prefabricated shower pans.

While mud beds provide a suitable shower base, they need to be waterproofed after installation and can crack over time, losing their water impermeability. As such, in many instances prefabricated shower pans are a preferred choice. Prefabricated shower pans are commonly fabricated as a pre-molded waterproof solid fiberglass or acrylic base having an aperture for the drain. They may be made as a single-body structure having an area designated for a drain outlet and having a consistent slope towards the drain area. Prefabricated shower pan bases are also quick and easy to install, as compared to laying mud beds. However, some single-body pans can be burdensome due to their large size, making it difficult to both handle and install such large pans.

Modular shower pan systems are another type of pre-molded shower pan system. These types of systems include a number of pre-molded pieces that are positioned and fit together at the installation site. For instance, U.S. Pat. No. 7,979,927 discloses a modular shower pan that includes polygon panels adapted to interlock in side-by-side manner using a plurality of outwardly extending interlocking bulbous projections and recesses along each side of each panel. While these interlocking locations are glued together, openings or cracks remain between the interlocking bulbous projections and recesses, which undesirably allows water to seep down under the assembled body and into the subfloor. Water that is trapped beneath a shower floor can cause severe water damage and compromise the structural integrity of your installation and home.

There is a need, therefore, for a modular shower pan system that allows easy and quick assembly while also providing and maintaining waterproofing over time.

SUMMARY OF THE INVENTION

Bearing in mind the problems and deficiencies of the prior art, it is therefore an object of the present invention to provide a modular shower pan system that allows easy and quick assembly, and is also waterproof.

Another object of the present invention is to provide a modular shower pan system having enhanced bonding to a flooring/substrate.

In accordance with the invention, one or more embodiments are directed to modular floor drain systems that includes two or more symmetric substrate segments each having outwardly extending flanges for overlapping an adjacent edge of the other substrate segment. The system also includes a drain segment connected to the two or more symmetric substrate segments via at least one of the outwardly extending flanges. The symmetric substrate segments have identical configurations enabling interchangeable use thereof and complementary mating for ease of installation of the modular floor drain system.

The symmetric substrate segments may have various geometric shapes and may be designed to fit square and/or circular drain substrate segments. The symmetric substrate segments may be a single structure that is rigid and non-bendable, or it may have hinges for bending and folding such substrate segment. In increasing bonding, the system to a flooring or substrate, the symmetric substrate segments may have a plurality of raised protrusions or recesses on back sides thereof for increased bonding with an adhesive, such as, mortar. Also, the symmetric substrate segments may be configured for central or point-type modular drain systems, or linear modular systems.

In other embodiments the invention is directed to a modular floor drain system that includes a plurality of symmetric substrate segments each having one or more hinges for bending the symmetric substrate segment to allow for folding thereof. The symmetric substrate segments have openings therein, which when positioned and adjoined to each other provide a drain segment in the plurality of symmetric substrate segments for forming a drain outlet.

In still other embodiments the invention is directed to a method of forming modular floor drain systems by providing first and second symmetric substrate segment having first and second outwardly extending flanges extending past one or more edges thereof. The first and second symmetric substrate segments have identical configurations. A drain substrate segment that has an opening for a drain outlet is provided, and then the first and second symmetric substrate segments are provided around the drain substrate segment. In doing so, the first and second outwardly extending flanges overlap the drain substrate segment. The identical configurations of the first and second symmetric substrate segments enable interchangeable use thereof and complementary mating for ease of installation of the modular floor drain system.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIGS. 40-42H are alternative embodiments of central drain substrates of the modular floor drain substrate of FIGS. 1A-1B.

DESCRIPTION OF EMBODIMENTS OF THE INVENTION

In describing the preferred embodiment of the present invention, reference will be made herein to FIGS. 1A-42H of the drawings in which like numerals refer to like features of the invention.

Figure 1A:
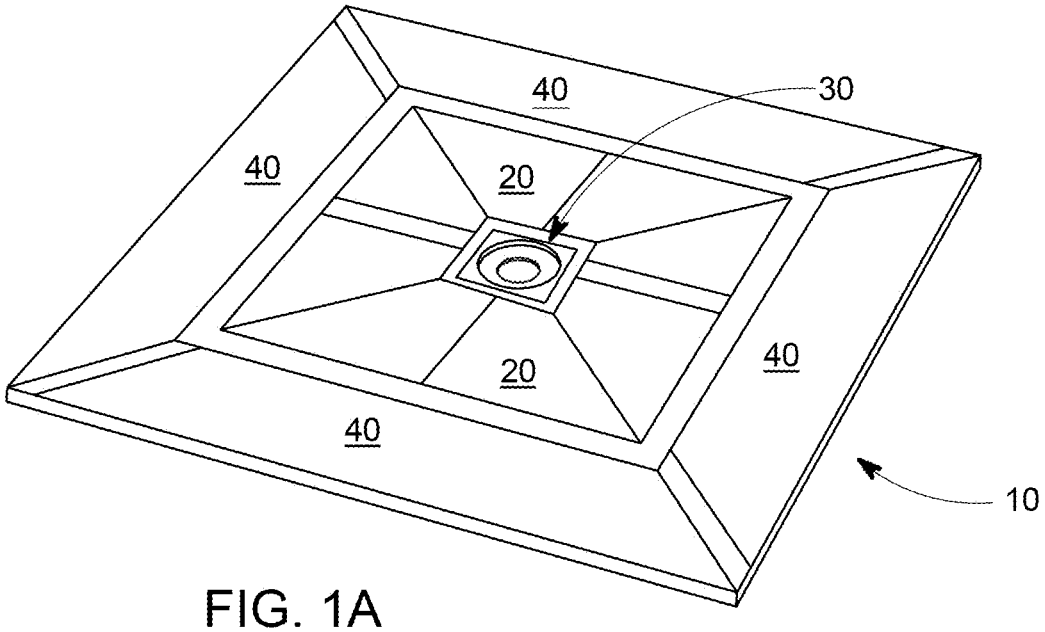
FIG. 1A is a top perspective view of an embodiment of the completed modular floor drain substrate of the present invention for use with a central or point-type drain prior to drain installation.
Figure 1B:
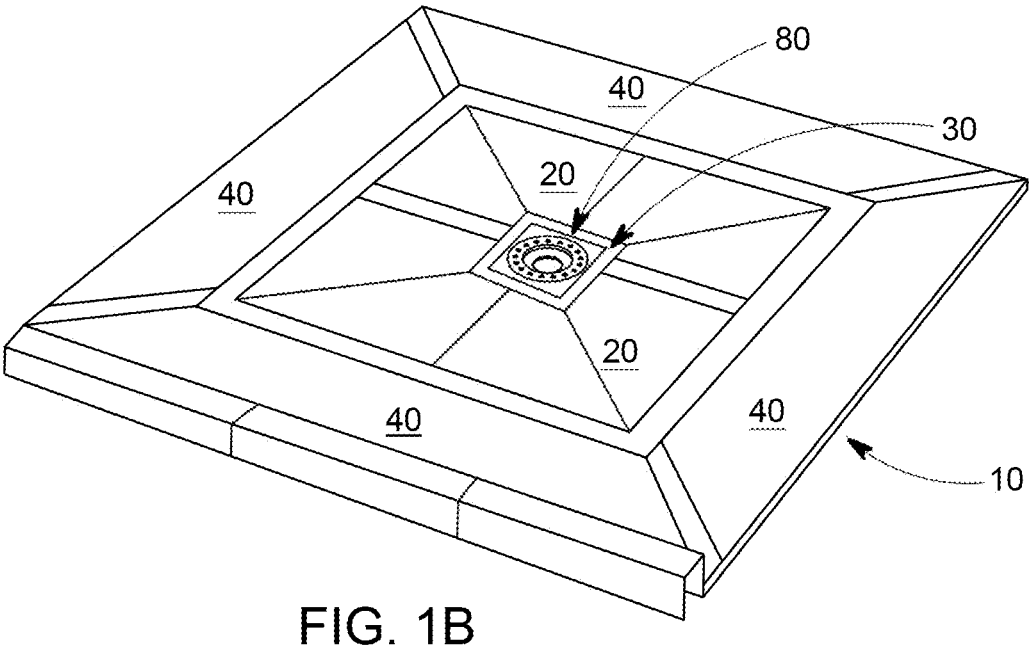
FIG. 1B is a top perspective view of an embodiment of the completed modular floor drain substrate of the present invention for use with a central or point-type drain after to drain installation.

A first embodiment of the modular floor drain substrate system, for installation over shower floors, is shown in FIGS. 1-26 and 36-42H, for use with a central or point-type drain. In its completed form as shown in FIGS. 1A and 1B, the modular floor drain substrate 10 comprises a pair of U-shaped inner substrate segments 20 which together surround a central drain substrate 30, the latter having a central opening for alignment with a drain pipe in the shower floor. FIG. 1B shows a drain 80 installed within the central drain substrate 30. Each inner substrate segment 20 is shown in this embodiment as being made up of two of each of trapezoidal shapes 20*a*, 20*b*, which are mirror images of each other, and formed as relatively thin plates, with each having shorter parallel edges 22 and longer parallel edges 24. Each trapezoid sub-segment or shape 20*a*, 20*b* has a lateral edge 26 perpendicular to each edge 22, 24, and a lateral edge 28 at a 45° angle to longer edge 24 (135° to shorter edge 22).

Figure 2:
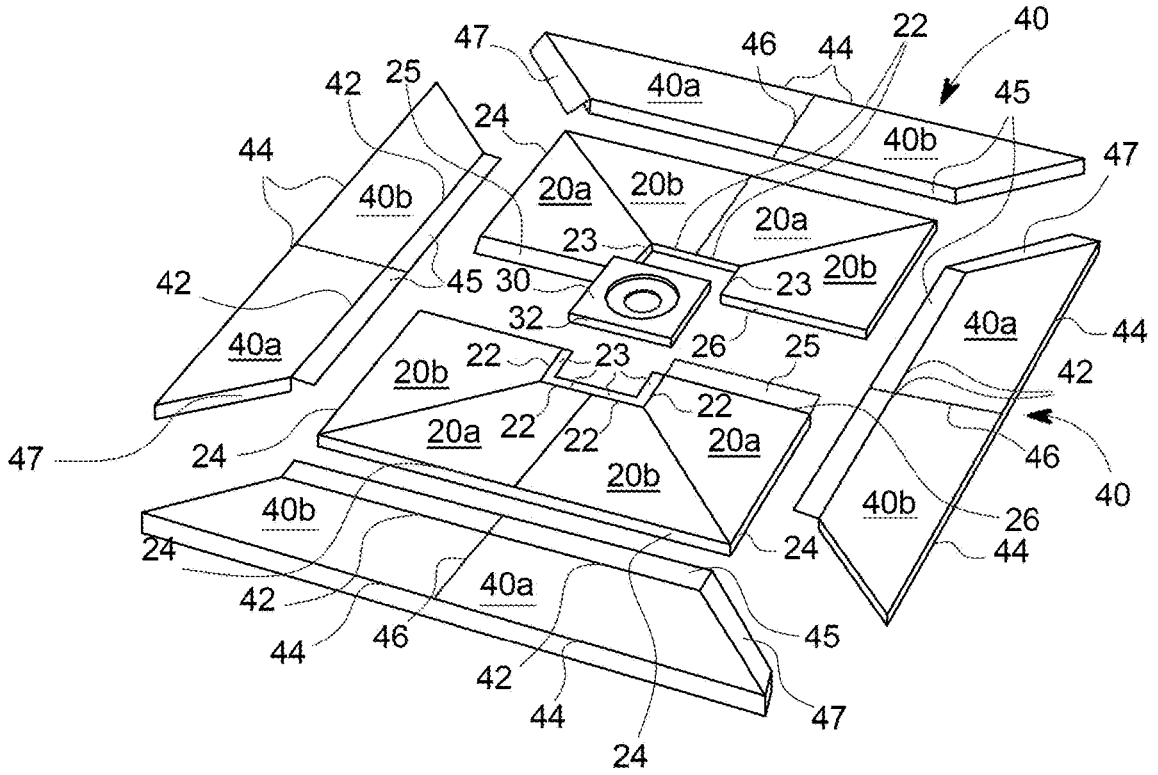
FIGS. 2 and 11A are top exploded views of the modular floor drain substrate of FIGS. 1A-1B.
Figure 4:
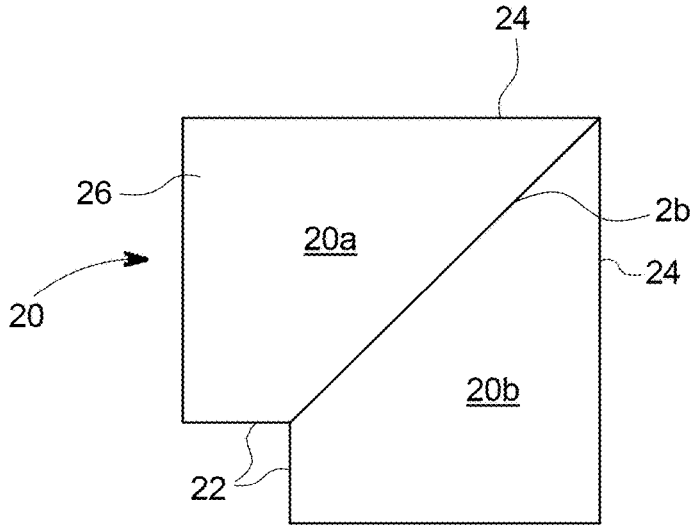
FIGS. 3A-B and 4 are top plan views of a portion (half) of the inner substrate segment of the modular floor drain substrate of FIGS. 1A-1B.
Figure 5:
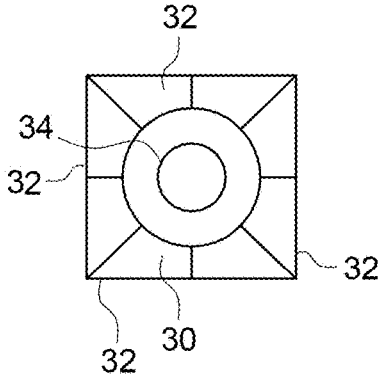
FIGS. 5 and 11B is a top plan view of the central drain substrate of the modular floor drain substrate of FIGS. 1A-1B.
Figure 9A:
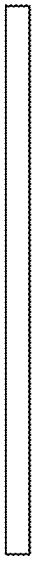
FIGS. 8 and 9A-9B are side elevational or cross-sectional views of the inner substrate segment of the modular floor drain substrate of FIGS. 1A-1B showing tapering of the thickness from the outer free edges 24 down to the inner free edges.
Figure 3A:
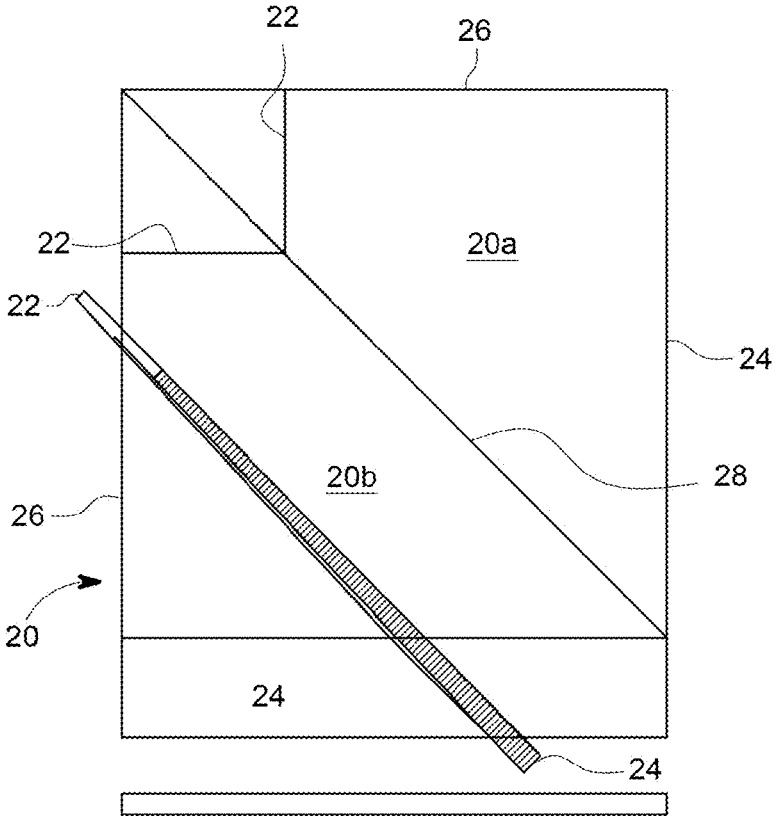
Figure 3B:
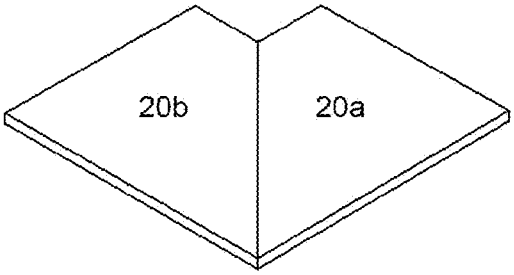
Figure 9B:
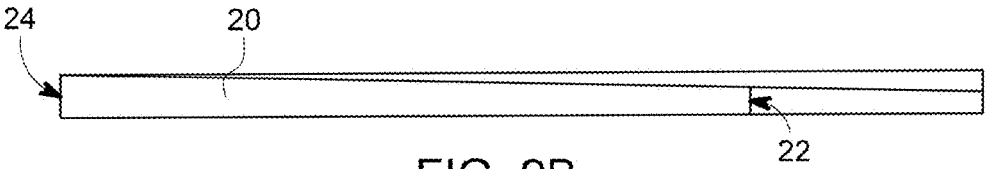

When formed from the two trapezoid shapes 20*a* and two trapezoid shapes 20*b* as shown in FIG. 2, each inner substrate segment 20 has a generally U-shape, with the free edges 24 on the outer (base and sides) "U" portion and free edges 22 on the inner (base and sides) "U" portion. Each inner substrate segment 20 has at the center the trapezoid shapes 20*a*, 20*b* connected along common perpendicular edges 26 and at the ends the trapezoid shapes 20*a*, 20*b* connected along common angled edges 28. The abutting edges 26 and 28 extend radially from inner free edges 22 to outer free edges 24. Each inner substrate segment 20 therefore has a rectangular shape, except for the side formed by perpendicular free edges 26 which has a relief portion formed by free edges 22 sized as half the configuration of the central drain substrate 30. When two inner substrate segments 20 are positioned with one "U" shape inverted relative to the other "U" shape, and the free edges 26 abutted, the relief portion formed by free edges 22 may surround a central square drain substrate 30. As shown in FIG. 5, central drain substrate 30 has side 32 dimensions of about two times the length of each trapezoid shape shorter inner edge 22, to provide a relatively tight fit between substrate 30 and substrates 20.

Figure 6:
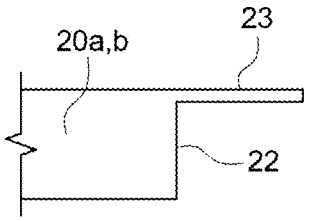
FIG. 6 is a side elevational or cross-sectional view of the flange extending from the inner free edge of the inner substrate segment of the modular floor drain substrate of FIGS. 1A-1B.
Figure 7:
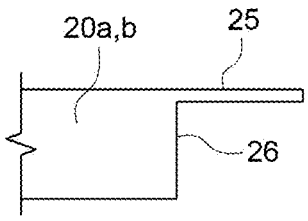
FIG. 7 is a side elevational or cross-sectional view of the flange extending from the perpendicular free edge of the inner substrate segment of the modular floor drain substrate of FIGS. 1A-1B.
Figure 8:
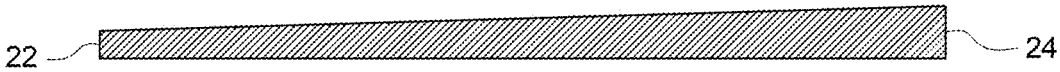

To enhance water-tightness, the inner substrate segment 20 has thin flanges 23, as shown in FIG. 6, that extend away from the upper portions of each shorter edge 22 along the top surface of segment 20. To further enhance water-tightness, there is provided a thin flange 25 as shown in FIG. 7 that extends away from the upper portions of one of the perpendicular free edges 26 on each inner substrate segment 20. When arranged in the relative inverted "U" configuration depicted in FIGS. 1A and 1B, with the free edges of two opposing inner substrate segment 20 abutting each other and surrounding the central substrate, the flange 25 on edge 26 of each inner substrate segment 20 extends over or overlaps the opposite edge 26 of the opposing, abutting inner substrate segment 20 having no flange to provide a connection between such segments 20. In surrounding the central substrate, the flanges 23 at each shorter edge 22 of each inner substrate segment 20 also extend over or overlap the edges 32 and periphery of the top surface of central substrate 30.

In accordance with the invention, the backside of each substrate segments 20, 40 are provided with a waterproofing sheet membrane that extends beyond certain edges of each segment 20, 40 to form the flanges of the invention (e.g., flanges 23, 25, 43 and 45). For instance, a suitable waterproofing sheet membrane is HYDRO BAN® Sheet Membrane. The back side of the central drain substrate 30 is also provided with the waterproofing sheet membrane to provide the entire assembly, once assembled, a water-tight or waterproofing assembly. In installation, each of the substrate segments is connected to an adjacent substrate segment whereby the flanges provided by the waterproofing sheet membrane connects to the top side of such adjacent substrate segment. In this manner, once all segments 20, 30, 40 are assembled to provide the system assembly 10, the topside thereof is a continuous layer of waterproofing sheet membrane that provides the pan assembly 10 with waterproofing capabilities.

In accordance with the invention, each inner substrate segment 20 is provided with the flanges 23 and 25 in an identical configuration, such that, all inner substrate segment 20 pieces are identical. This is beneficial as it provides easy installment for the end user, and avoids the need to determine piece reference numbers, sides, distinguish between left and right sided pieces, etc., as all inner substrate segments 20 of the invention are identical and allow for interchangeable use, complementary mating, and installation.

Figure 35A:
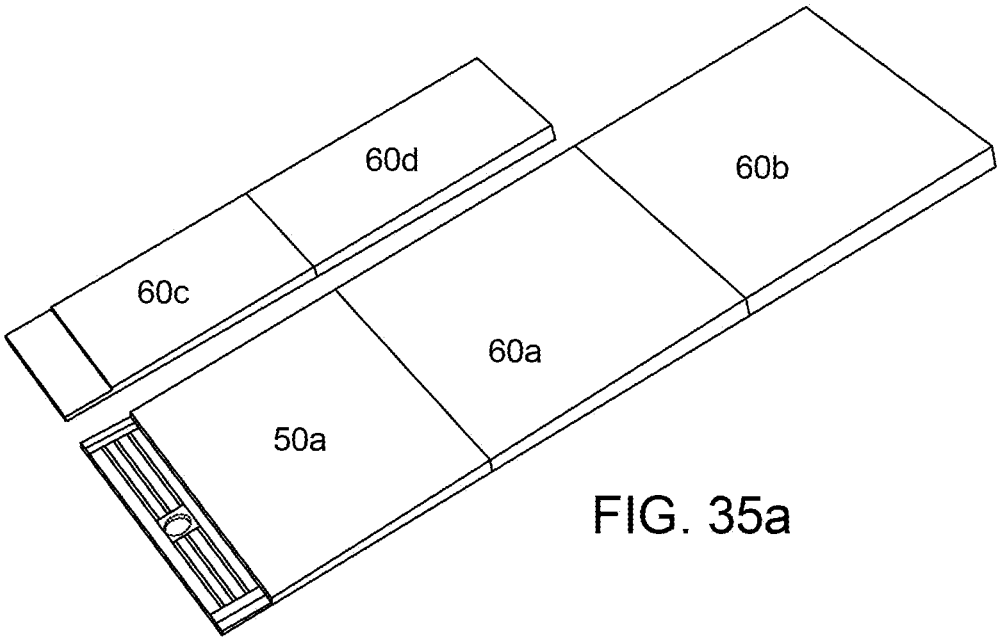
FIG. 35A is a top side perspective view, partially exploded, showing the modular floor drain substrate of FIG. 27 having a sloped top surface.
Figure 35B:
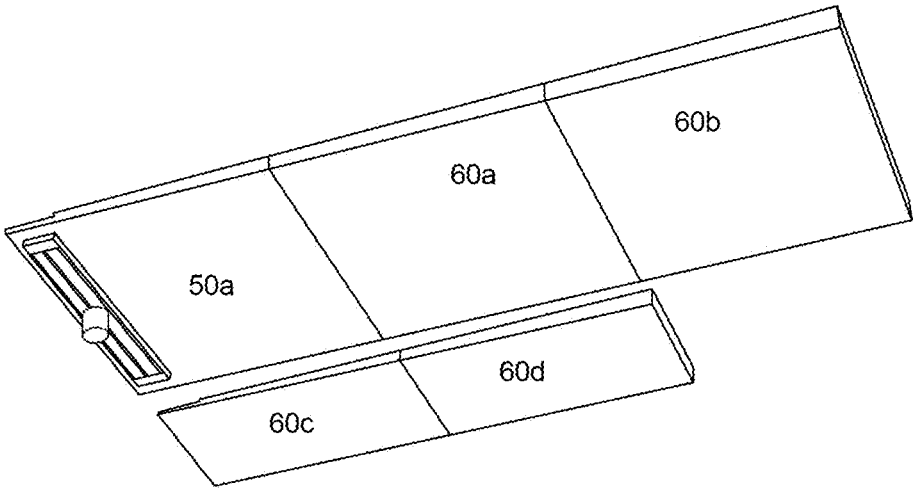
FIG. 35B is a bottom side perspective view, partially exploded, showing the modular floor drain substrate of FIG. 27 having a flat bottom (back) surface.
Figure 35C:
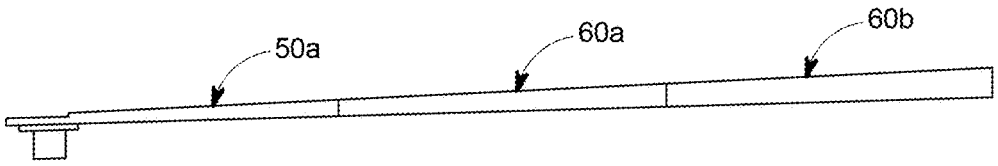
FIG. 35C is a side view showing the modular floor drain substrate of FIG. 27 having a sloped top surface.
Figure 36:
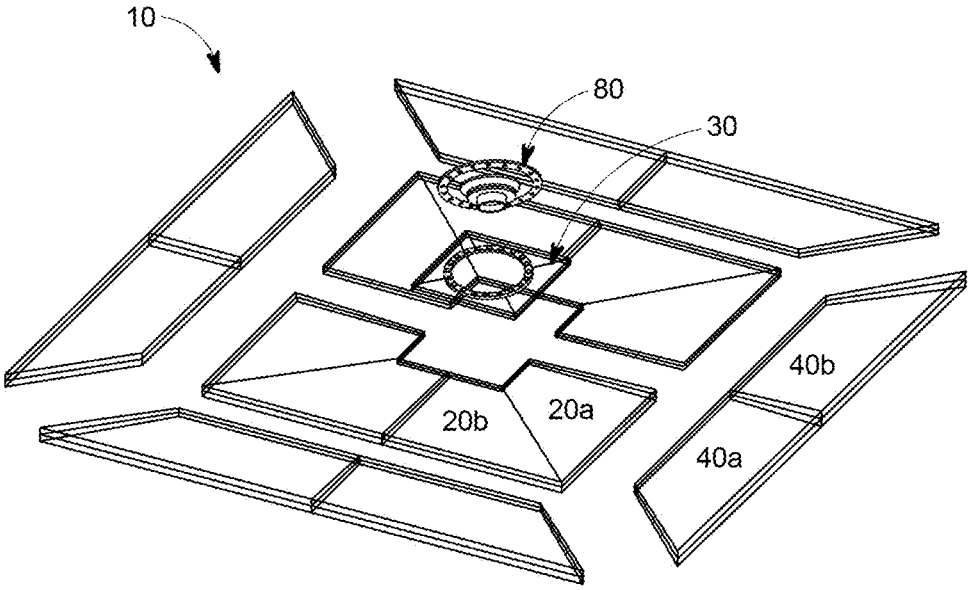
FIGS. 36-38 are alternative views of the modular floor drain substrate of FIGS. 1A-1B having a central or point-type drain.
Figure 37:
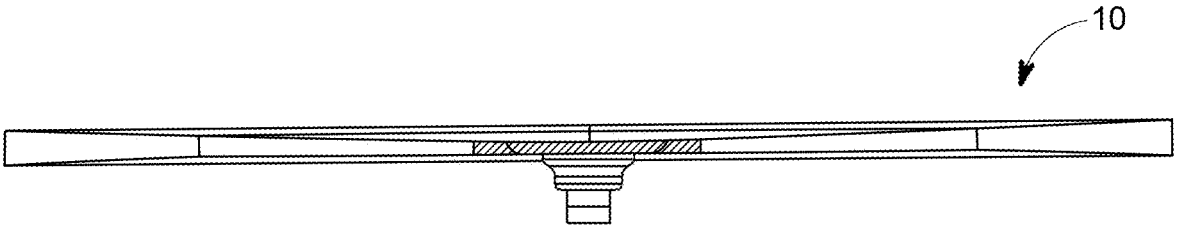
Figure 38:
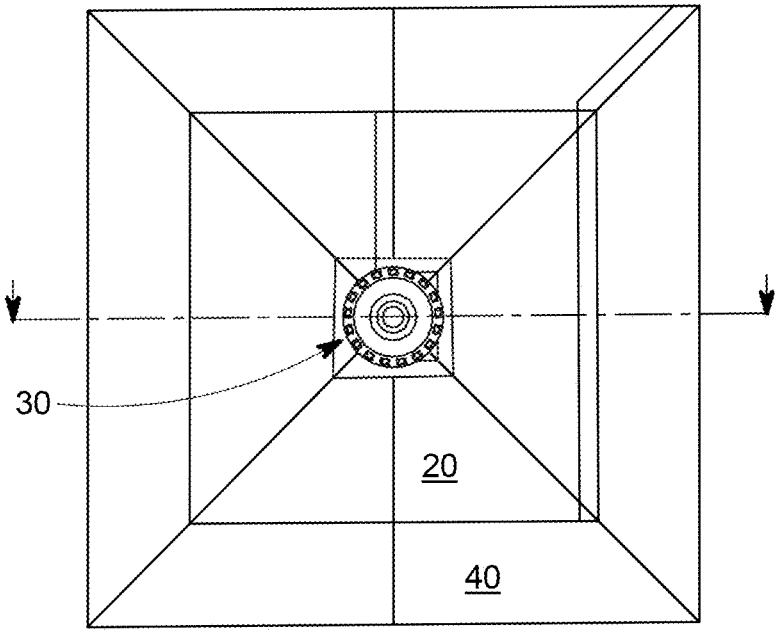
Figure 39:
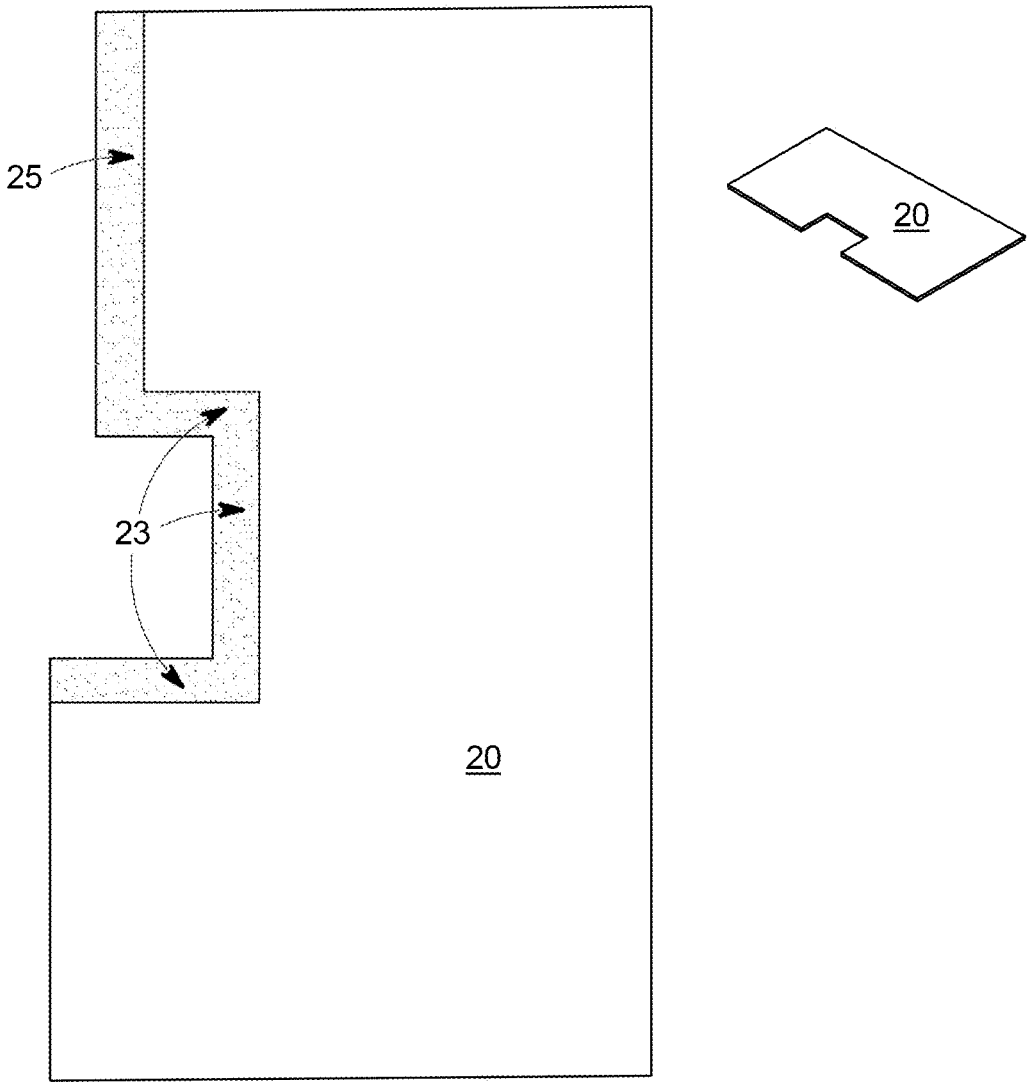
FIG. 39 is a top plan view of the inner substrate segment of the modular floor drain of the invention showing flanges extending from predetermined inner free edges of such inner substrate segment that overlap another adjacent inner substrate segment in the present modular floor drain substrate of FIGS. 1A-1B.

The top surfaces of the joined inner substrate segments 20 may receive facing materials such as ceramic tiles. So that water will properly flow by gravity to the central substrate 30 and out the central opening 34 to the drain, the thickness of the inner substrate segments 20 tapers down from a greater thickness at outer "U" free edges 24 to a lesser thickness at inner "U" free edges 22 to provide a sloped drain assembly or system. This is shown on side views in FIGS. 8 and 9 of edges 26 and 28, respectively. The sloped configuration of the present modular floor drain system is also shown in FIGS. 35A-C.

In the embodiment shown, the substrate segments dimensions may be any desired to cover the floor of the shower, for example, inner substrate segment 20 edges 22 of 6 in., and edges 24 of 24 in., and central substrate 30 edges of 12 in. (All dimensions in Figs. Are shown in inches.) The substrate segments may be adhered to the floor in any usual manner, whereby the waterproofing sheet membrane attached to the top or frontside of the substrate segments provides the assembly with a continuous waterproofing layer.

Figure 10A:
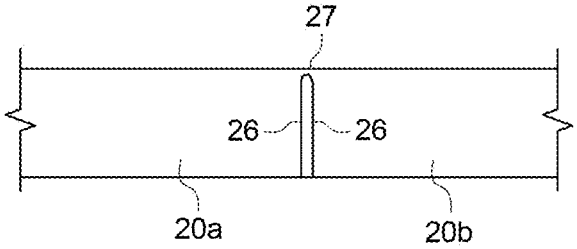
FIGS. 10A-10B are side elevational or cross-sectional views of the hinge between halves of the inner substrate segment of the modular floor drain substrate of FIGS. 1A-1B showing the halves in unfolded and folded positions, respectively.
Figure 10B:
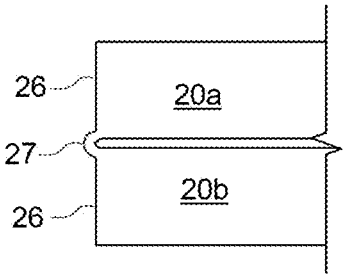
Figure 11A:
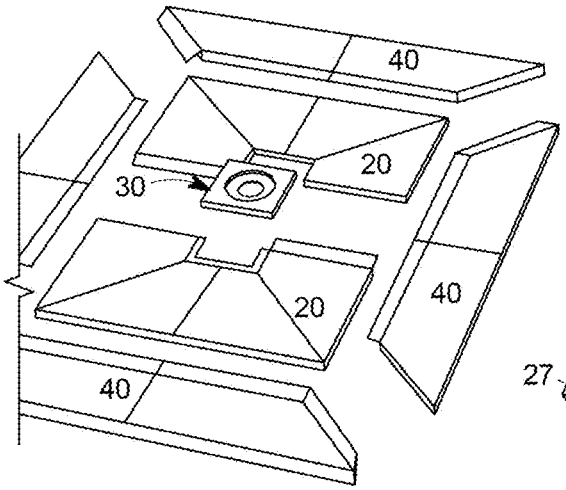
Figure 14:
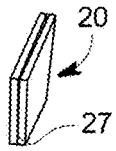
FIGS. 12-14 are top perspective views showing the sequence of an inner substrate segment of the modular floor drain substrate of FIGS. 1A-1B being folded in half between open position to storage/shipping position.
Figure 24:
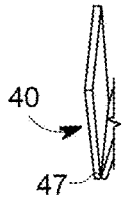
FIGS. 22-24 are top perspective views showing the sequence of an outer substrate segment of the modular floor drain substrate of FIGS. 1A-1B being folded in half between open position to storage/shipping position.
Figure 13:
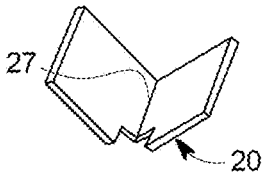
Figure 23:
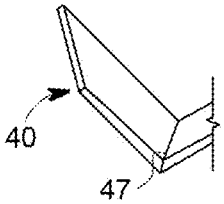
Figure 12:
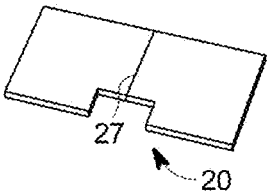
Figure 22:
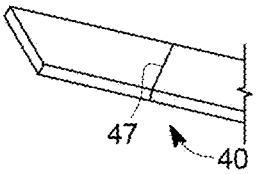
Figure 11B:
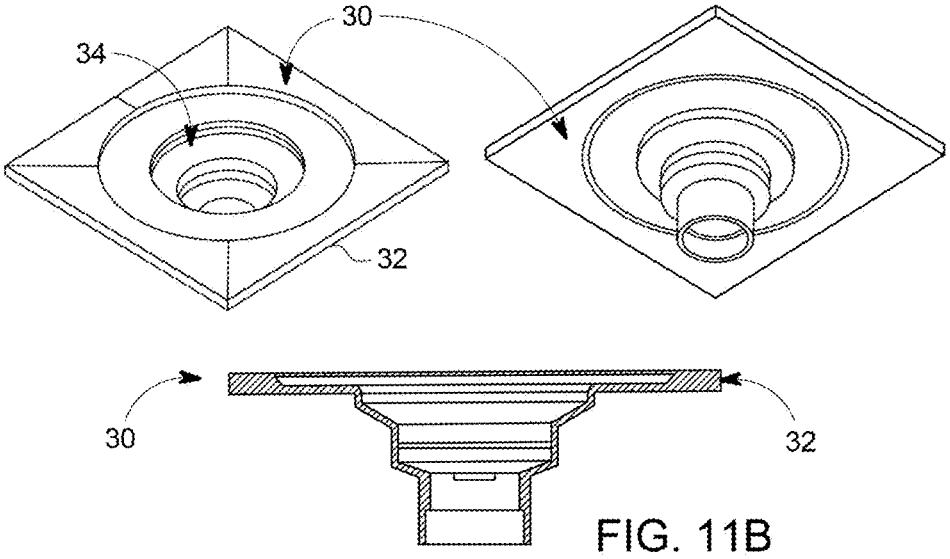

Inner substrate segment 20 may be made of any material suitable to support ceramic tiles or the desired facing material, such a plastic, foam, rubber, polystyrene, other polymers, or other similar materials, as well as any cementitious materials (e.g., mortar, adhesives, grout, etc.) used in the ordinary course of flooring (e.g., tile, stone, etc.) installation. Each trapezoid shape 20*a*, 20*b* may be separately formed and secured along the common edges to form inner substrate segment 20, or two or more trapezoid shapes 20*a*, 20*b* may be formed as a unitary piece. To enable inner substrate segment 20 to be stored and/or shipped in a more compact manner, one or more hinges may be provided between adjacent trapezoid shapes 20*a*, 20*b*, so that the inner substrate segment 20 may be folded. An example hinge 27 is shown in FIGS. 10 and 11 in unfolded and folded positions, respectively. Hinge 27 may be a living hinge for example, where adjacent trapezoid shapes 20*a*, 20*b* are made as a unitary piece, and hinge 27 is a thin, flexible portion between edges 26 of the two shapes. Alternatively, a thin, flexible material may be adhered to the top surfaces of adjacent, separately formed trapezoid shapes 20*a*, 20*b* to provide hinge 27. For instance, the thin, flexible material may be the waterproofing sheet membrane. The hinge may be in position in the center of the inner substrate segment 20 so that it may be folded in half, as shown being folded between open position to storage/shipping position in the sequence of FIGS. 12-14. This enables a relatively long piece to be stored and shipped in a package half as long.

Shower floors of greater dimension may be accommodated by the use of two inner substrate segments along with employing outer substrate segments 40, as shown in completed form in FIGS. 1A and 1B. Each of the four outer substrate segments 40 is shown in this embodiment as being made up of two trapezoidal sub-segments or shapes 40*a*, 40*b*

(FIGS. 15 and 16), which are mirror images of each other, and formed as relatively thin plates, with each having shorter parallel edges 42 and longer parallel edges 44. Each trapezoid sub-segment or shape 40*a*, 40*b* has a lateral edge 46 perpendicular to each edge 42, 44, and a lateral edge 48 at a 45° angle to longer edge 44 (135° to shorter edge 42).

When trapezoid shapes 40*a* and 40*b* are joined along perpendicular edge 46 as shown in FIG. 2, each outer substrate segment 40 has a configuration of an isosceles trapezoidal, with the shorter parallel free edge having a dimension of twice the shorter free edges 42, and the longer parallel free edge having a dimension of twice the longer free edges 42. As depicted, each shorter free edge 42 has the same dimension as the longer free edge 24 of the inner trapezoid shapes 20*a*, 20*b*. Each outer substrate segment 40 may therefore be positioned with the shorter free edge adjacent to and abutted with the outer edges 24 of the combined inner substrate segments 20, to extend the outer dimensions of the modular floor drain substrate from twice the length of edge 24 by twice the length of perpendicular edge 46, as shown in FIG. 1. When the four outer substrate segments 40 are so configured around the inner substrate segments, angled edges 48 are abutted with adjacent outer substrate segments and extend radially from inner free edges 42 to outer free edges 44.

Figure 17:
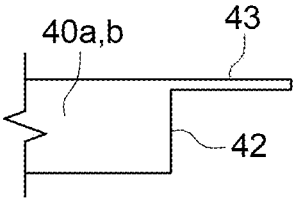
FIG. 17 is a side elevational or cross-sectional view of the flange extending from the inner free edge of the outer substrate segment of the modular floor drain substrate of FIGS. 1A-1B.
Figure 18:
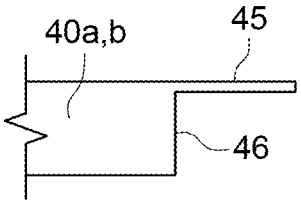
FIG. 18 is a side elevational or cross-sectional view of the flange extending from the angled free edge of the outer substrate segment of the modular floor drain substrate of FIGS. 1A-1B.
Figure 19:
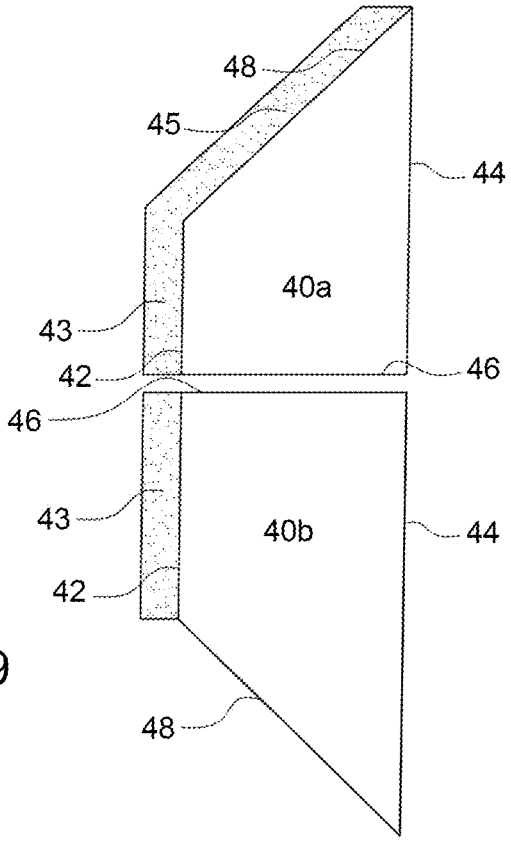
FIG. 19 is a top plan view of the flanges extending from the free edge of the outer substrate segment in FIGS. 17 and 18.

As shown in FIGS. 17 and 19, thin flanges 43 of waterproofing sheet membrane may be provided that extend away from the upper portions of each shorter edge 42, along the top surface of trapezoid shapes 40*a, b*, and inward over the edges 24 and periphery of the top surface of inner substrate segments 20 to enhance water-tightness. For the same reason, there is provided a thin flange 45 as shown in FIGS. 18 and 19 that extends away from the upper portion of the angled free edge 46 on outer substrate shape 40*a* (but not on shape 40*b*). When arranged surrounding inner substrate segments 20 as depicted in FIG. 1 with the free edges abutted, flange 45 on angled edge 46 of each outer substrate trapezoid shape 40*a* extends over the abutting angled edge 46 on each outer substrate trapezoid shape 40*b*, that has no flange.

Figure 15:
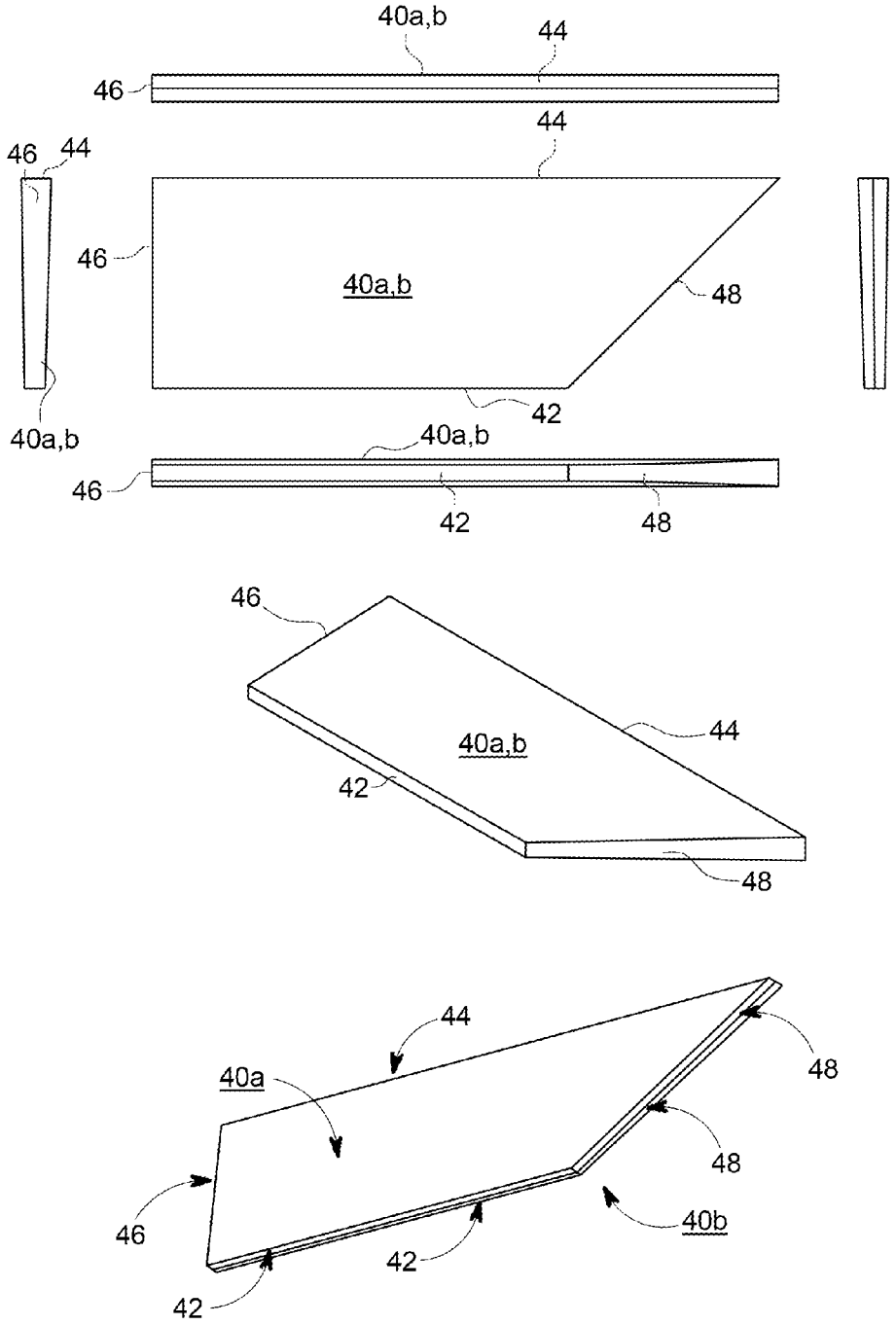
FIG. 15 shows perspective, top plan and side elevational views of a portion (half) of the outer substrate segment of the modular floor drain substrate of FIGS. 1A-1B.
Figure 16:
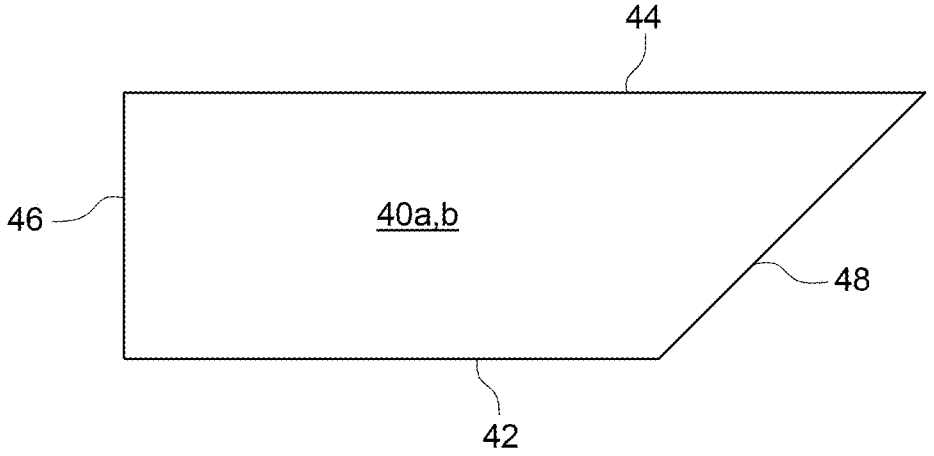
FIG. 16 is a top plan view of a portion (half) of the outer substrate segment of the modular floor drain substrate of FIGS. 1A-1B.

As with the inner substrate segments 20, to assist gravity water flow by gravity to the inner substrate segments 20 and to the central substrate 30 and out the central opening 34 to the drain, the thickness of the outer substrate trapezoid shapes 40*a, b* tapers down from a greater thickness at outer, longer free edges 44 to a lesser thickness at inner, shorter free edges 42, as shown on side and perspective views of edges 46 and 48 in FIG. 15. The thickness at inner, shorter free edges 42 of the outer substrate segments 40 will be substantially the same as the thickness of the outer free edges 24 of inner substrate segments 20.

Figure 20:
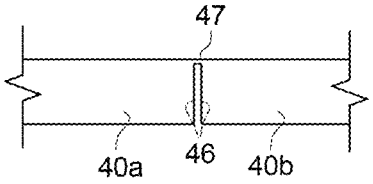
FIGS. 20 and 21 are side elevational or cross-sectional views of the hinge between halves of the outer substrate segment of the modular floor drain substrate of FIGS. 1A-1B showing the halves in unfolded and folded positions, respectively.
Figure 21:
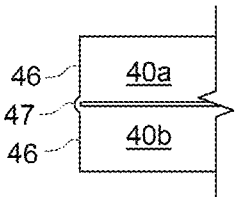

The dimensions of outer substrate trapezoid shapes 40*a, b* may correspond to the dimensions of inner substrate segment 20, for example, outer substrate segment edges 42 of 24 in., and edges 44 of 36 in. Outer substrate segment 40 may be made of any material suitable to support ceramic tiles or the desired facing material, such as plastic, foam, rubber, polystyrene, other polymers, or other similar materials, and each trapezoid shape 40*a*, 40*b* may be separately formed and secured along the common edges to form outer substrate segment 40, or the trapezoid shapes 40*a*, 40*b* may be formed as a unitary piece. To enable outer substrate segment 20 to be stored and/or shipped in a more compact manner, a hinge may be provided between adjacent trapezoid shapes 40*a* and 40*b*, so that the outer substrate segment 40 may be folded. An example hinge 47 is shown in FIGS. 20 and 21 in unfolded and folded positions, respectively. As with hinge 27, hinge 47 may be a living hinge for example where adjacent trapezoid shapes 20*a*, 20*b* are made as a unitary piece, or made from a thin, flexible material adhered to the top surfaces of adjacent, separately formed trapezoid shapes 40*a, b*. The hinge may be position in the center of the inner substrate segment 40 so that it may be folded in half, as shown being folded between open position to storage/shipping position in the sequence of FIGS. 22-44. Again, this enables a relatively long piece to be stored and shipped in a package half as long.

Figure 25:
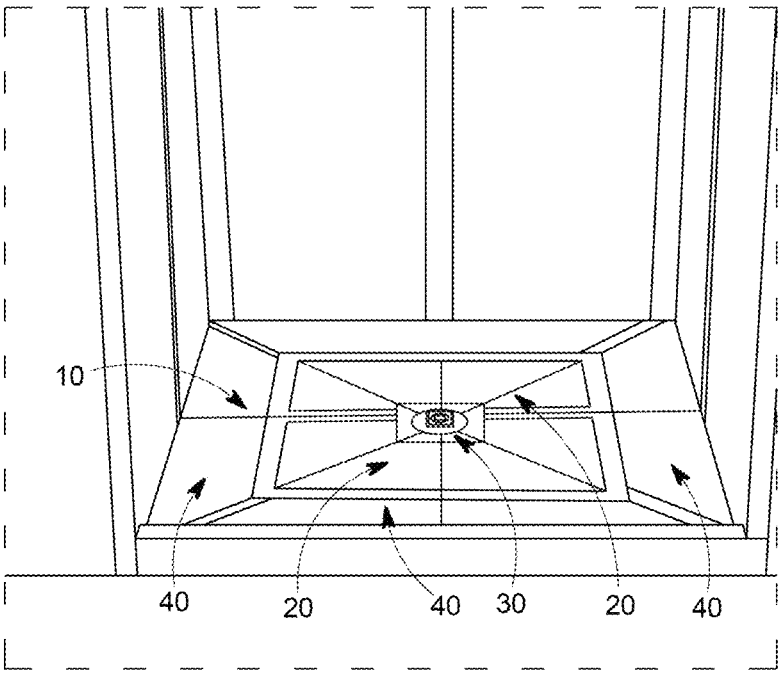
FIG. 25 is a perspective view of the embodiment of the completed modular floor drain substrate system including drain insert of the present invention for use of FIGS. 1A-1B installed on the floor of a shower enclosure.
Figure 26:
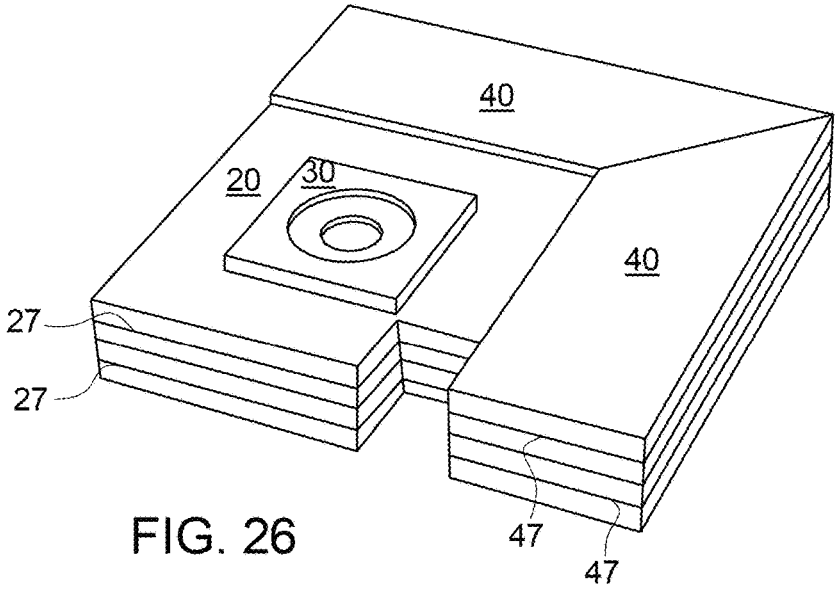
FIG. 26 is a perspective view of the modular floor drain substrate system of the present invention, shown in FIGS. 1A-1B and 25, with the inner and outer substrate segment folded and stacked with the central drain segment for storage or shipment.

The completed modular floor drain substrate system of the present invention as installed on the floor of a shower enclosure is shown in FIG. 25, where the outer dimensions according to the examples are 72 in. by 72 in. The same modular floor drain substrate system is shown in FIG. 26 with the inner and outer substrate segment folded and stacked with the central drain segment for storage or shipment, with outer dimensions of 36 in. by 36 in. Thus, the present invention enables the storage/shipment footprint to be only one-quarter of the final installed dimensions. Alternate views of various center-drain modular floor drain systems and component parts thereof are depicted in FIGS. 36-42H in accordance with the invention.

Figure 27:
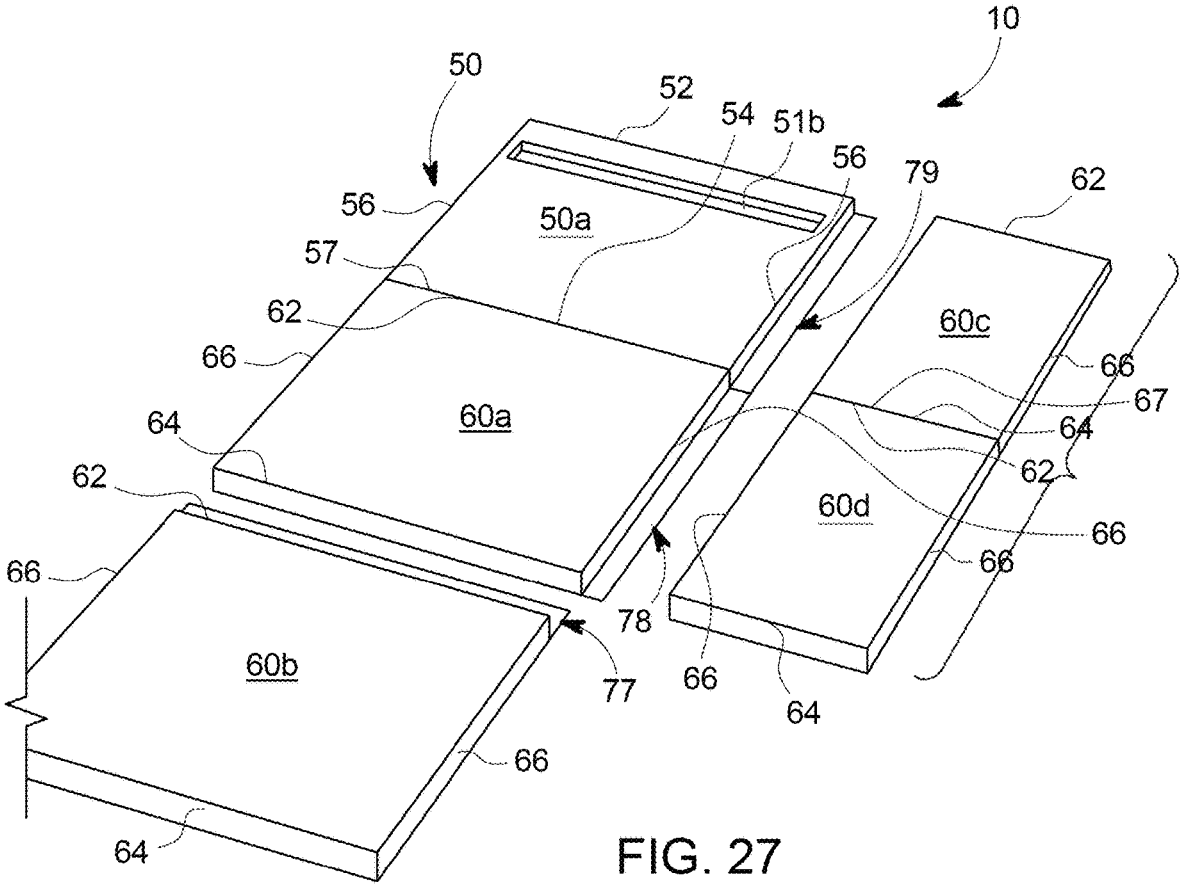
FIG. 27 is a top perspective view, partially exploded, of a configuration of the modular floor drain substrate of the present invention for use with a linear-type drain near one end of the shower floor.

A second embodiment of the modular floor drain substrate system, for installation over shower floors, is shown in FIGS. 27-35C, for use with a linear-type drain. In its form as shown in FIG. 27, the modular floor drain substrate 10 comprises a linear drain substrate segment 50 which in one configuration is made up of a rectangular sub-segment or shape 50*a* formed as a relatively thin plate, having edge 52 near linear drain opening 51*a* and parallel edge 54 distal from the drain opening. Lateral edges 26 are perpendicular to edges 52 and 54. Linear drain opening 51*a* as shown is entirely within shape 50*a*, has a length generally parallel to and extends substantially the entire length of edge 52, and may be rectangular. For facilitation of gravity flow of the water to the drain, the thickness of shape 50*a* tapers down from a greater thickness at distal free edge 54 to a lesser thickness at free edge 52 and linear drain opening 51*a*, as shown on lateral edges 56.

Rectangular sub-segments or shapes 60*a*, 60*b*, 60*c* and/or 60*d*, also formed as relatively thin plates but having no drain openings, may be used to add to shape 50*a* to achieve the desired dimensions needed for the shower floor, as shown in the drawings. In this configuration, the linear drain opening is closer to one end of the shower floor, so no rectangular shapes are added along edge 52 of shape 50*a*. Each rectangular shape has edge 62 nearest the drain opening and parallel edge 64 distal from the drain opening, and perpendicular lateral edges 66 connecting edges 62 and 64. Shape 60*a* is shown adjacent rectangular shape 50*a*, with edge 62 of the former abutting edge 54 of the latter. Likewise, shape 60*b* is shown adjacent rectangular shape 60*a*, with edge 62 of the former abutting edge 54 of the latter. Similarly, rectangular shapes 60*c* and 60*d* are adjacent each other with abutting edges 64 and 62, and the two are adjacent rectangular shapes 50*a* and 60*a*, respectively with abutting lateral edges 66.

Figure 28:
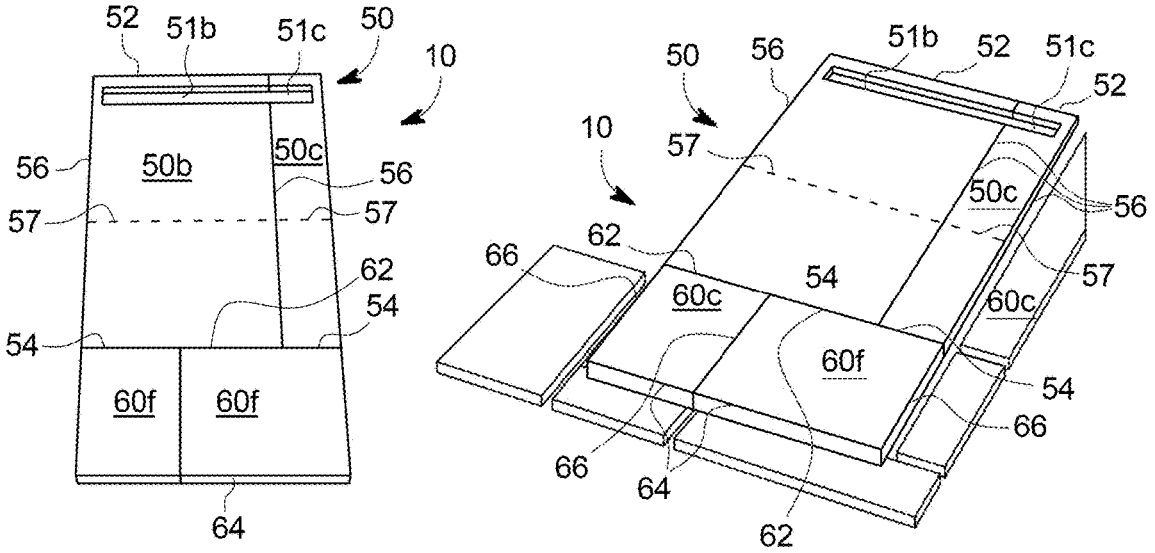
FIG. 28 is a top perspective view of a second configuration of the modular floor drain substrate of the present invention for use with a linear-type drain.

FIG. 28 shows another configuration of the modular floor drain substrate 10 with linear drain substrate segment 50 is made up of a rectangular sub-segment or shape 50*b*, again formed as a relatively thin plate with edge 52 near linear drain opening 51*b* and parallel edge 54 distal from the drain opening. In this configuration linear drain opening 51*b* has a length generally parallel to and extends substantially the entire length of edge 52 and may be rectangular, but as shown extends completely to and is exposed at one edge 56.

Another thin plate, rectangular sub-segment or shape 50*c* also has rectangular linear drain opening 51*c* generally parallel to and extending substantially the entire length of edge 52 and extending completely to and being exposed at one edge 56. Rectangular shape 50*c* has edges 52, 54 shorter than edges 52, 54 of shape 50*b*. Rectangular linear drain substrate shapes 50*b* and 50*c* are abutted along lateral edges 56 having the exposed ends of drain openings 51*b* and 51*c*, respectively. Additional rectangular shapes 60*e*, 60*f* having no drain openings and configured in the same manner as described above are provided to add to and achieve the desired shower floor dimensions.

Figure 29:
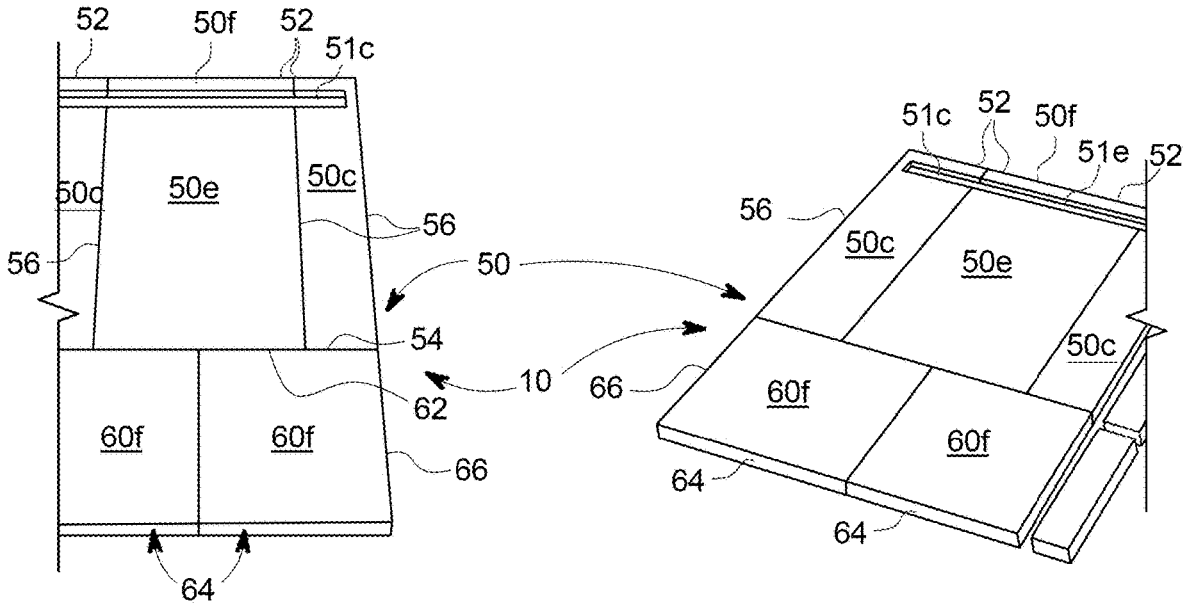
FIGS. 29 and 30 are top perspective views of a third configuration of the modular floor drain substrate of the present invention for use with a linear-type drain.
Figure 30:
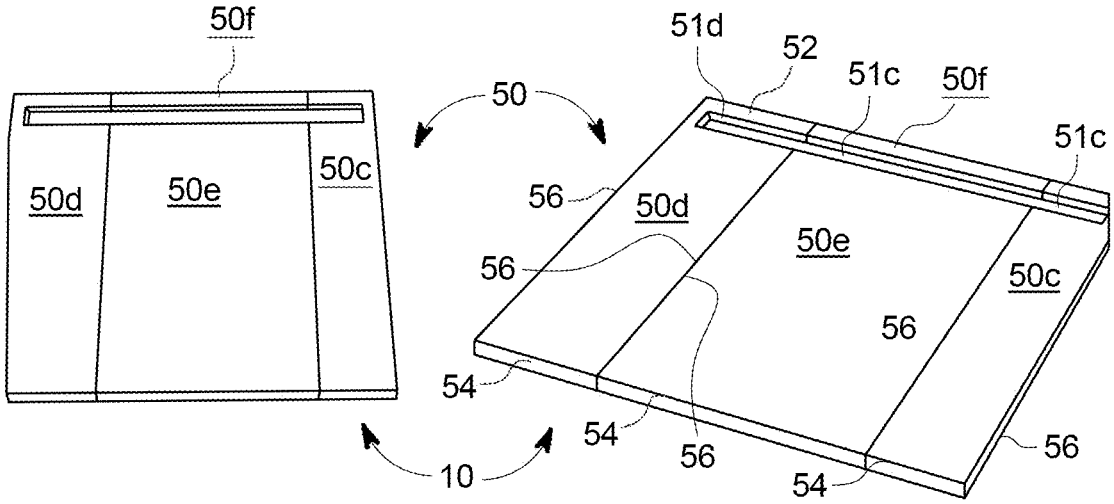

A further configuration of the modular floor drain substrate 10 with linear drain substrate segment 50 is shown in FIGS. 29 and 30, with thin plate rectangular sub-segment or shapes 50*e* and 50*f*. In this instance linear drain opening 51*c* has a length generally parallel to and extending the entire length of edge 52 so that it is exposed at both opposite edges 56. In the configuration of FIG. 29 a pair of shapes 50*c* are abutted along lateral edges 56 on either side of shapes 50*e*, 50*f* so that drain openings 51*e* and 51*c* are connected and the drain opening extends substantially across the combined widths (edge 22 lengths) of shapes 50*c* and 50*e*. In the configuration of FIG. 30 a shape 50*c* is abutted along lateral edge 56 on one side of shapes 50*e*, 50*f* so that drain openings 51*e* and 51*c* are connected. Another rectangular shape 50*d* of wider width is provided on the opposite side with drain opening 51*d* exposed on one edge and connected to drain opening 51*e*. The combined drain openings 50*c*, 50*d* and 50*e* extends substantially across the combined widths (edge 22 lengths) of shapes 50*c*, 50*d* and 50*e*. Additional rectangular shapes 60*f* (FIG. 29) may be configured in the same manner as described above achieve the desired shower floor dimensions.

As shown by the configurations in FIGS. 28, 29 and 30, longer linear drain openings may be created where the shower linear drain is longer than the width (edge lengths 52, 54) of a single rectangular shape. For facilitation of gravity flow of the water to the drain, the thickness of shape 50*a* tapers down from a greater thickness at distal free edge 54 to a lesser thickness at free edge 52 and linear drain opening 51*a*, as shown on lateral edges 56.

Figure 31:
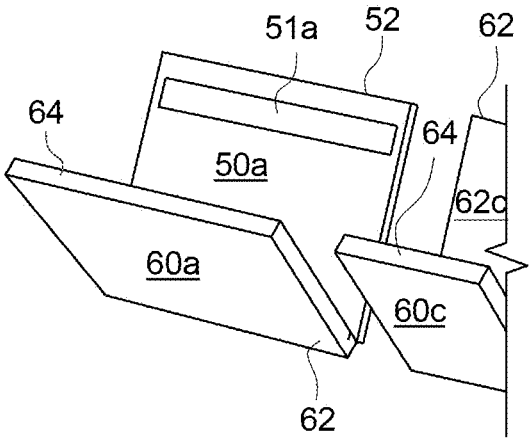
FIGS. 31-32 are top perspective views showing the sequence of the modular floor drain substrate of FIG. 27 being folded in half between open position to storage/shipping position.
Figure 32:
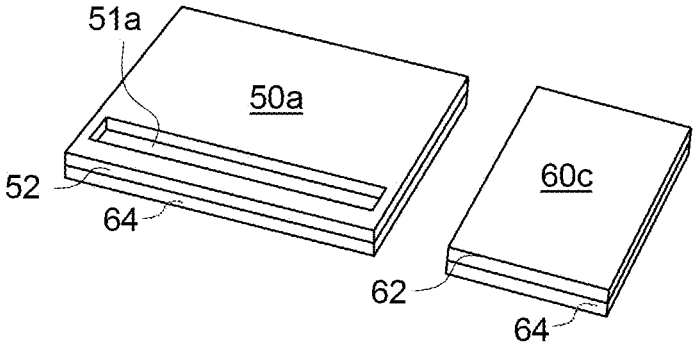
Figure 33:
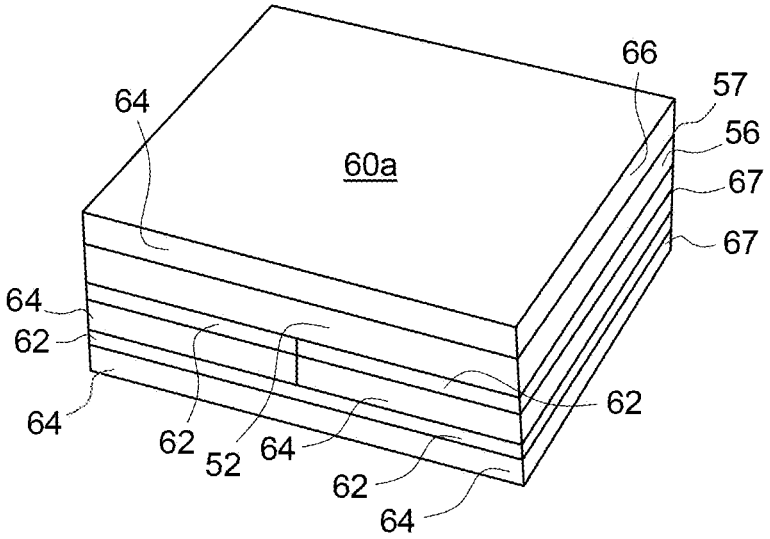
FIG. 33 is a perspective view of the modular floor drain substrate system of the present invention, shown in FIG. 27, with the rectangular shapes folded and stacked for storage or shipment.
Figure 34A:
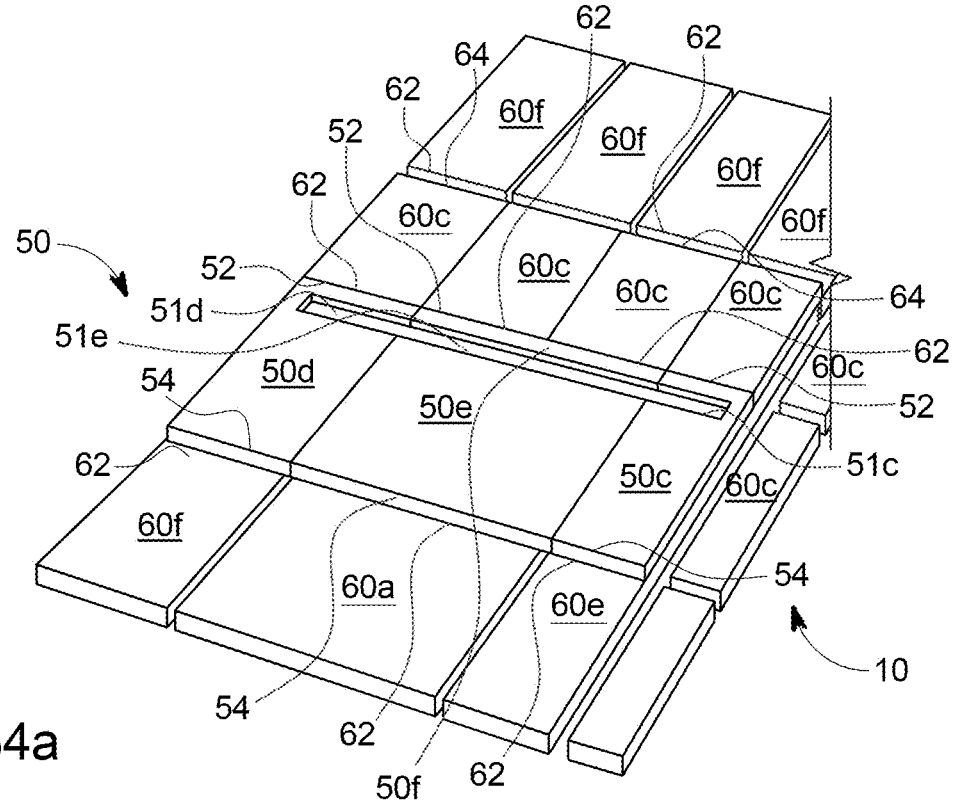
FIGS. 34A-34B are top perspective views, partially exploded, of another configuration of the modular floor drain substrate of the present invention for use with a linear-type drain near the center of the shower floor.
Figure 34B:
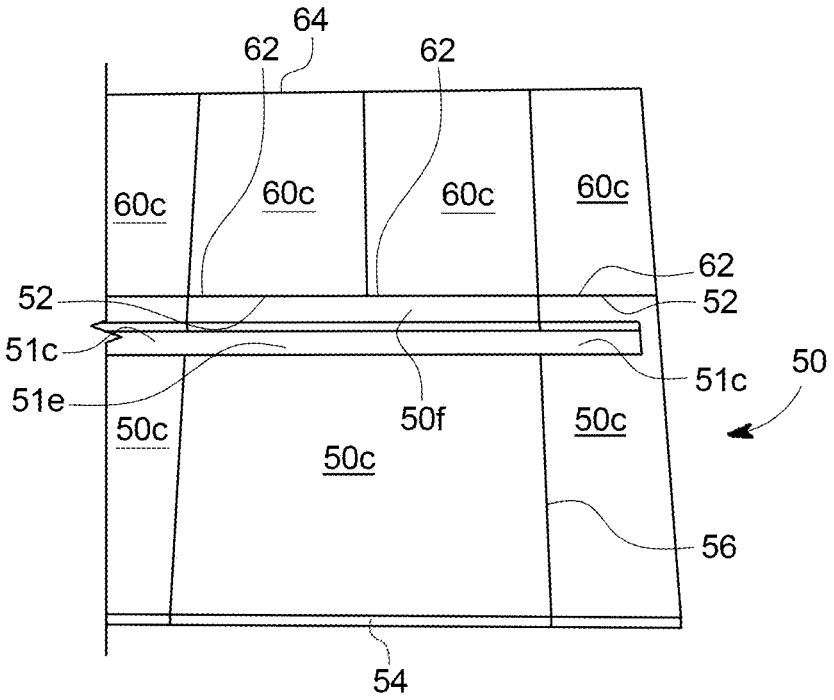

One or more hinges may be provided in a manner similar to hinges 27 and 47, again to enable the rectangular shapes to be folded up to more compact dimensions for storage and/or shipment. For example, in FIG. 27 a living or other type of hinge 57 may be provided along the abutting edges 54, 62 of rectangular shapes 50*a*, 60*a*, respectively, and/or living or other type of hinge 67 may be provided may be provided along the abutting edges 64, 62 of rectangular shapes 60*c*, 60*d*, respectively. Both may be folded in half, as shown in the sequence of FIGS. 31 and 32 between the partially open and the storage/shipping positions. Alternatively, a living or other type of hinge 57 may be optionally provided midway between edges 52 and 54 of rectangular shapes 50*b* and 50*c*, as shown in FIG. 28. The rectangular shapes as folded and stacked for storage or shipment are shown in FIG. 33.

Where the linear drain is desired to be in the center of the shower floor, a configuration of the modular floor drain substrate 10 is shown in FIG. 34. Linear drain substrate segment 50 is made up rectangular shapes, 50*c*, 50*d*, 50*e* and 50*f* abutted along respective lateral edges 56 with drain openings 51*c*, 51*d* and 51*e* connected, as in FIG. 30. To position combined drain 51*c*, 51*d* and 51*e* near the center of the shower floor, additional rectangular shapes 60*c* and 60*f* may be positioned on the side of edges 52 of rectangular shapes, 50*c*, 50*d*, 50*e* and 50*f*, and rectangular shapes 60*a*, 60*e* and 60*f* may be positioned on the side of edges 54 of rectangular shapes, 50*c*, 50*d*, 50*e* and 50*f*, in the same manner as described above.

All rectangular shapes 60*a*, 60*b*, 60*c*, 60*d*, 60*e*, 60*f* are tapered down from a greater thickness at distal free edge 64 to a lesser thickness at free edge 62, as shown on lateral edges 66 in the various drawing figures. The thickness of free edge 62 will be substantially the same as that of the edge of the abutting rectangular shape edge 54, 62 or 64, as the case may be, to ensure the flow of water toward the linear drain, it may be located near one end of the shower floor, or centrally located.

As with the modular substrates used with the central drain, the rectangular segments for the linear drain may be made of any material suitable to support ceramic tiles or the desired facing material, such as plastic, foam, rubber, polystyrene, other polymers, or other similar materials. Similar to the first two embodiments of the invention, the rectangular shapes 60*a*, 60*b*, 60*c*, 60*d*, 60*e*, 60*f* may include a thin, flexible waterproofing sheet membrane attached to the topsides thereof for providing waterproofing capabilities, as well as forming flanges 77, 78, 79 (see, FIG. 27) similar to flanges 23, 25, 43 and 45 for joining adjacent rectangular shapes together and providing a water-tight seal and connection. These flanges 77, 78, 79 extend away from one or more of edges along the top surface of the rectangular shapes 50*a*, 50*b*, 50*c*, 50*d*, 50*e* and 50*f* and 60*a*, 60*b*, etc., so that they may extend over the edges and peripheries of the top surfaces of abutting rectangular shapes that have no flanges, to enhance water-tightness.

Figure 43:
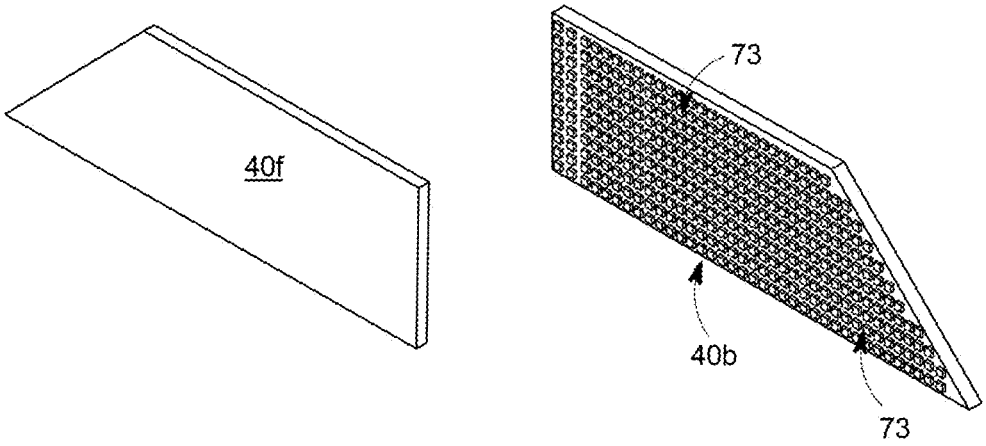
FIG. 43 illustrates raised protrusions on the bottom side of the various substrate segments in accordance with the invention.
Figure 44:
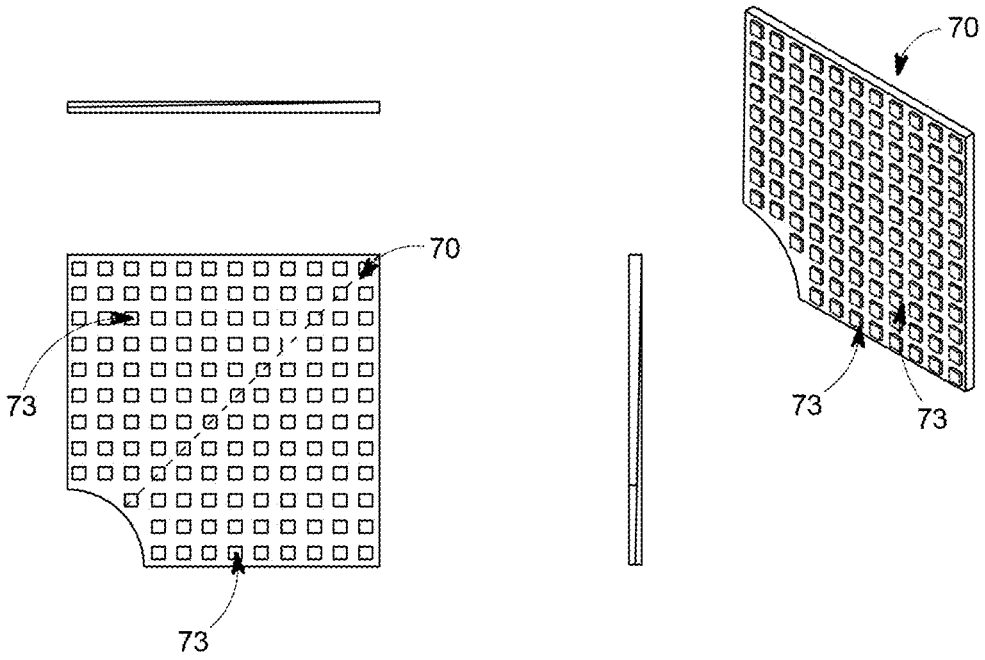
FIG. 44 illustrates an alternate embodiment of the invention having substrate segments with rounded edges, rather than square, for receiving a round bonding flange.
Figure 45:
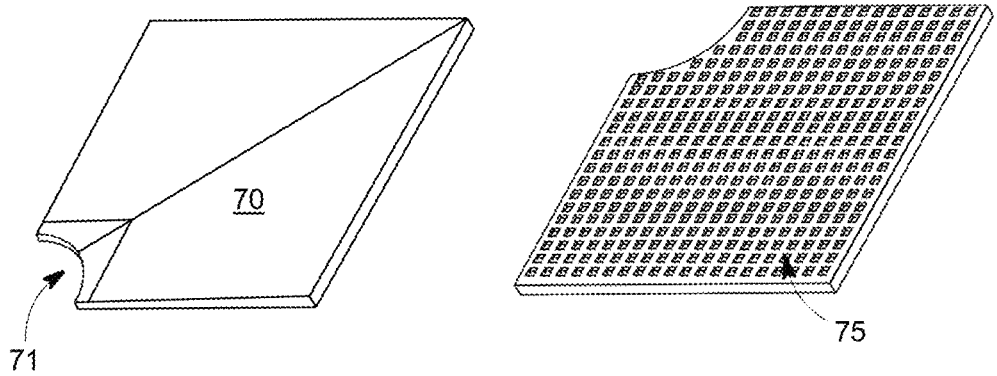
FIG. 45 illustrates still another embodiment of the invention whereby the present substrate segments having rounded edges for receiving a round bonding flange, as well as have recessed portions on the bottom side of each substrate segment for receiving a material (e.g., mortar) that secures such segments to a floor or substrate.
Figure 46A:
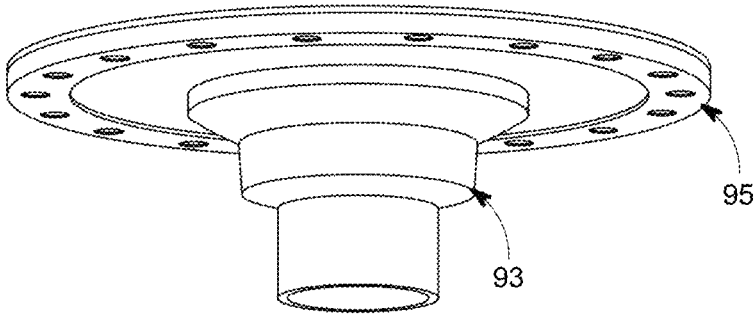
FIGS. 46A-46C illustrate a support ring secured to a bonding flange for use with a rounded substrate segment of the invention.
Figure 46B:
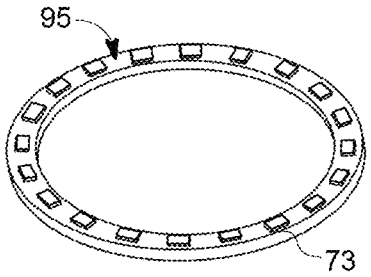
Figure 46C:
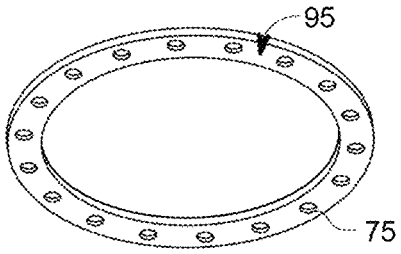
Figure 47:
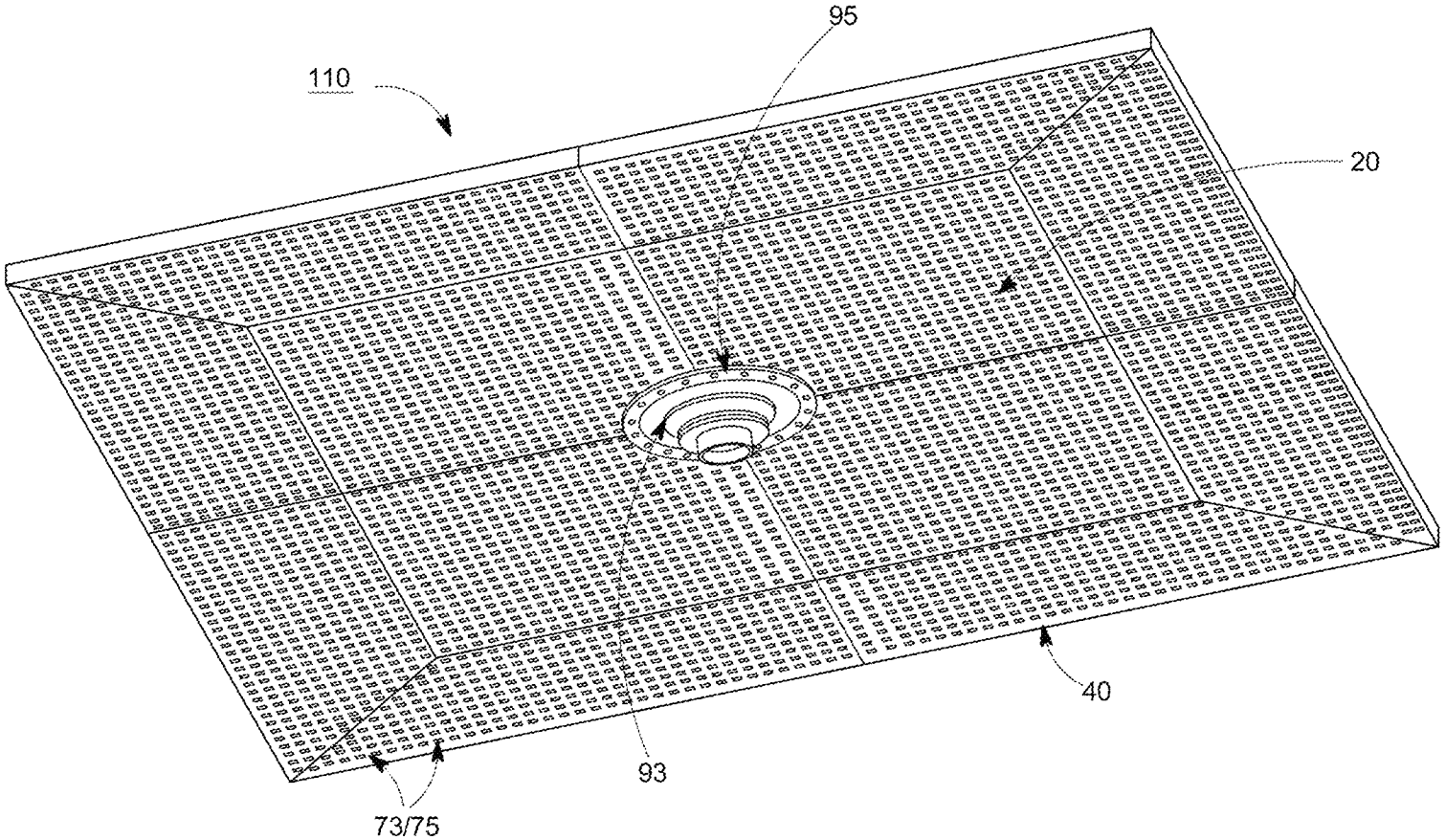
FIG. 47 illustrates an assembly of the invention including the rounded substrate segments having the support ring secured to a bonding flange, with the system having raised protrusions or recesses for increasing bonding of the assembly to a flooring/substrate.

Other embodiments of the present modular floor drain substrate system, for installation over shower floors, are shown in FIGS. 43-47. In accordance with the invention, the various substrate segments disclosed herein may also include raised protrusions 73 on the backside thereof, or alternatively recesses 75, for securing the present substrate segments to a floor. FIG. 43 illustrates the front side 40(*f*) of substrate segment 40 having a planar top, while its back side 40(*b*) has a number of raised protrusions 73. These raised protrusions 73 may have a height of about 1 inch, or higher or smaller. The raised protrusions 73 provide increased surface area and bonding locations for mortar or thinset to contact and be trapped between adjacent raised protrusions 73 for securing the substrate segment to the floor. The raised protrusions 73 also minimize slippage of the assembly in the mortar/thinset due to the gripping or grasping nature thereof. FIG. 44 also depicts the raised protrusions 73 on an alternate rounded substrate segment 70 of the invention. As shown in FIGS. 44 and 45, this substrate segment 70 includes a rounded edge portion 71 for receiving the drain segment comprising a support ring 95 that receives a bonding flange 93 (see, FIGS. 46A-46C). Alternate to the raised protrusions 73 residing in a grid pattern, the bottom surfaces of the present substrate segments may include recesses 75 residing there across for capturing mortar or another adhesive to bond the segments to a flooring or other substrate.

While the present invention has been particularly described, in conjunction with a specific preferred embodiment, it is evident that many alternatives, modifications and variations will be apparent to those skilled in the art in light of the foregoing description. It is therefore contemplated that the description will embrace any such alternatives, modifications and variations as falling within the true scope and spirit of the present invention.

The invention claimed is:

1. A modular floor drain system comprising:

two or more symmetric substrate segments;

two or more waterproofing sheet membranes, wherein each of the two or more symmetric substrate segments has one of the two or more waterproofing sheet membranes attached thereto, each of the two or more waterproofing sheet membranes having one or more outwardly extending flanges for overlapping an adjacent edge of the other waterproofing sheet membrane; and a drain segment connected to the two or more symmetric substrate segments via at least one of the outwardly extending flanges on each of the two or more symmetric substrate segments, whereby the two or more symmetric substrate segments have identical configurations enabling interchangeable use thereof and complementary mating for ease of installation of the modular floor drain system, and whereby the two or more waterproofing sheet membranes attached to the symmetric substrate segments provides a continuous waterproofing layer of the modular floor drain system.

2. The system of claim 1 wherein the two or more symmetric substrate segments comprise a first set of symmetric substrate segments having outwardly extending flanges via the two or more waterproofing sheet membranes having a first shape configured cover the first set of symmetric substrate segments, and a second set of symmetric substrate segments having outwardly extending flanges via others of the two or more waterproofing sheet membranes having a second shape configured cover the second set of symmetric substrate segments, wherein the first and second sets of symmetric substrate segments have different geometric shapes, and the second set of symmetric substrate segments increases the dimensional size of the first set of symmetric substrate segments.

3. The system of claim 2 wherein all substrate segments in the first set of symmetric substrate segments have identical configurations.

4. The system of claim 2 wherein all substrate segments in the second set of symmetric substrate segments have identical configurations.

5. The system of claim 1 wherein each of the symmetric substrate segments is a non-bendable rigid structure of a single monolithic substrate segment.

6. The system of claim 1 wherein each of the symmetric substrate segments is a single monolithic piece having one or more hinges for bending said piece.

7. The system of claim 6 wherein the one or more hinges comprise a living hinge that is a part of the symmetric substrate segments.

8. The system of claim 6 wherein the one or more hinges comprise separate hinge components added to the symmetric substrate segments.

9. The system of claim 1 further including a plurality of raised protrusions or recesses on a backside of each said symmetric substrate segment for receiving a material for attaching each said symmetric substrate segment to a floor.

10. The system of claim 1 wherein each of the symmetric substrate segments have a sloped top surface for providing a sloped modular floor drain system that slopes downward towards the drain segment.

11. The system of claim 1 wherein the drain segment is a central or point-type drain to provide a central modular floor drain system.

12. The system of claim 1 wherein the drain segment is a linear drain to provide a linear modular floor drain system.

13. The system of claim 1 wherein the drain segment is a support ring for receiving a bonding flange.

14. A modular floor drain system comprising a plurality of symmetric substrate segments each having one or more hinges for bending said symmetric substrate segment to allow for folding thereof;

a plurality of waterproofing sheet membranes each having one or more flange portions, each of the symmetric substrate segments having one of the plurality of waterproofing sheet membranes attached thereto whereby the one or more flange portions of the waterproofing sheet membranes form outwardly extending flanges of the symmetric substrate segments for overlapping adjacent edges of adjacent symmetric substrate segments; and at least one of the symmetric substrate segments having an opening therein, which when positioned and adjoined to each the other symmetric substrate segments provide a drain segment for forming a drain outlet of the modular floor drain system.

15. The system of claim 14 wherein the drain segment comprises a linear drain to provide a linear modular floor drain system.

16. The system of claim 14 further including one or more of said plurality of symmetric substrate segments having one or more flanges extending outward from lateral edges thereof to overlap adjacent substrate segments.

17. The system of claim 14 wherein the plurality of symmetric substrate segments have a variety of different sizes to fit a predefined installation area.

18. A method of forming a modular floor drain system comprising:

providing a first symmetric substrate segment having a first waterproofing sheet membrane on a surface thereof, the first waterproofing sheet membrane having one or more first membrane outwardly extending flanges that extend past one or more edges of the first symmetric substrate segment;

providing a second symmetric substrate segment having a second waterproofing sheet membrane on a surface thereof, the second waterproofing sheet membrane having one or more second membrane outwardly extending flanges that extend past one or more edges of the second symmetric substrate segment, the first and second symmetric substrate segments having identical configurations;

providing a drain substrate segment having an opening for a drain outlet;

positioning the first and second symmetric substrate segments around the drain substrate segment whereby the one or more first membrane outwardly extending flanges on the first symmetric substrate segment overlap both the drain substrate segment and at least one edge of the second symmetric substrate segment, while the one or more second membrane outwardly extending flanges on the second symmetric substrate segment overlap both the drain substrate segment and at least one edge of the first symmetric substrate segment providing a continuous waterproofing layer, the identical configurations of the first and second symmetric substrate segments enabling interchangeable use thereof and complementary mating for ease of installation of the modular floor drain system.

19. The method of claim 18 wherein the drain segment is a central or point-type drain to provide a central modular floor drain system.

20. The method of claim 18 wherein the first and second symmetric substrate segments each have one or more hinges for bending and folding said first and second symmetric substrate segments for ease or storage or transportation.

* * * * *